United States Patent [19]

Wandless

[11] Patent Number: 4,782,912

[45] Date of Patent: Nov. 8, 1988

[54] ENGINE AIR CLEANER - NOISE REDUCER

[75] Inventor: Darrel G. Wandless, Dearborn Heights, Mich.

[73] Assignee: Ford Motor Company, Dearborn, Mich.

[21] Appl. No.: 27,478

[22] Filed: Mar. 18, 1987

[51] Int. Cl.[4] ..... F02M 35/00

[52] U.S. Cl. ..... 181/229; 181/255; 181/264; 181/269

[58] Field of Search ..... 181/229, 243, 230, 264, 181/269

[56] References Cited

U.S. PATENT DOCUMENTS

| | | | |
|---|---|---|---|
| 1,521,400 | 12/1924 | Shaw | 181/269 |
| 2,510,441 | 6/1950 | Vokes | 181/229 X |
| 2,954,096 | 9/1960 | McMullen | 181/229 X |
| 3,120,876 | 2/1964 | Lirette | 181/229 |
| 4,197,922 | 4/1980 | Weber et al. | 181/229 |
| 4,408,679 | 10/1983 | Littrell | 181/252 X |
| 4,449,609 | 5/1984 | Stoll | 181/230 |

*Primary Examiner*—B. R. Fuller

*Attorney, Agent, or Firm*—Robert E. McCollum; Clifford L. Sadler

[57] ABSTRACT

A combination air inlet - engine noise silencer consists of a shell-type housing of large volume having a small volume air inlet tube at one end and an outlet of restricted area at another portion at right angles to the inlet for direct passage into the engine induction system, the air inlet tube containing a conical-like insert coaxially mounted with its apex facing upstream to provide a base portion at right angles to the axis of the inlet tube whereby engine acoustical waves passing from the engine towards the inlet are reflected against the base portion of the cone back into the expansion chamber to be dissipated and broken-up thereby reducing the engine noise, the cone concurrently increasing the velocity of the air flow into the engine proper to increase operating efficiency.

5 Claims, 2 Drawing Sheets

10
12
14
16
26
30
40
42

ENGINE AIR CLEANER - NOISE REDUCER

This invention relates in general to a combination air inlet-engine noise silencer for an automotive type internal combustion engine. More particularly, it relates to one in which a conical-like insert is placed in the inlet tube to the engine for enhancing the flow of air to the engine, while simultaneously blocking a return into the inlet of engine acoustical waves by reflecting the same off the base of the conical-like insert to be broken-up and dissipated.

Combination air cleaner-engine noise silencers are known. For example, U.S. Pat. No. 2,510,441, Vokes, shows an air inlet to a cylindrical casing that includes a conical-like member 4 in the inlet having a flat base portion that cooperates with a resonator tube for silencing engine feedback noises. However, in this case, the air must pass around the base portion of the cone into a small inlet of the resonator tube for passage therefrom at right angles into an annular space 18 prior to emerging therefrom for passage into an outlet 19. The air flow thus is restricted to flow in a labyrinthian-like path resulting eventually in poor pressure recovery, loss of increased velocity and, therefore, less than efficient operation of the engine.

U.S. Pat. No. 3,120,876, Lirette, shows an air intake silencer having a reversely directed conical member in the inlet including a conical portion 28 facing a larger reversely directed conical portion 24 causing a 360° change in direction of the air prior to entering the inlet of the blower or machine. The engine feedback noises are deflected somewhat by the reverse cone 24. However, the cone defines a path for passage of the acoustical waves back towards the inlet.

U.S. Pat. No. 1,521,400, Shaw, shows an exhaust eduction attachment and muffler, including an inlet having a divided path around a conical-like portion prior to passage out through a duct of constant diameter. This is a typical muffler-type installation and unlike that of the invention where the engine acoustical waves are reflected back towards the engine, unlike the case here.

U.S. Pat. No. 2,954,096, McMullen, shows an air intake inlet tuning tube 29 having holes delivering air into a resonator chamber at right angles thereto. In this case, engine acoustical waves can pass back into the tube 29 and into the inlet without necessarily being diverted through the holes 31 into the resonator chamber.

The invention provides, and none of the above prior shows, a simple construction of an air inlet tube connected to an expansion chamber having an outlet directed to the engine induction system and one in which a conical-like insert is placed in the inlet tube for enhancing the air flow into the engine and simultaneously blocking the reverse flow of acoustical or sound waves from the engine back into the inlet.

It is a primary object of the invention, therefore, to provide a combination air inlet-engine noise silencer consisting of a shell-like housing having an air inlet tube into one portion of the housing and an outlet from the housing at right angles to the inlet, the inlet tube containing a conical-like insert having apex and base portions axially aligned in the tube to increase the velocity of the air flow and lower the pressure for an efficient passage into the engine while simultaneously reflecting the engine induction sound waves off the base portion of the insert into the expansion chamber to be dissipated therein and absorbed.

Other objects, features and advantages of the invention will become more apparent upon reference to the succeeding, detailed description thereof, and to the drawings illustrating the preferred embodiment thereof; wherein.

Figures 1, 2:
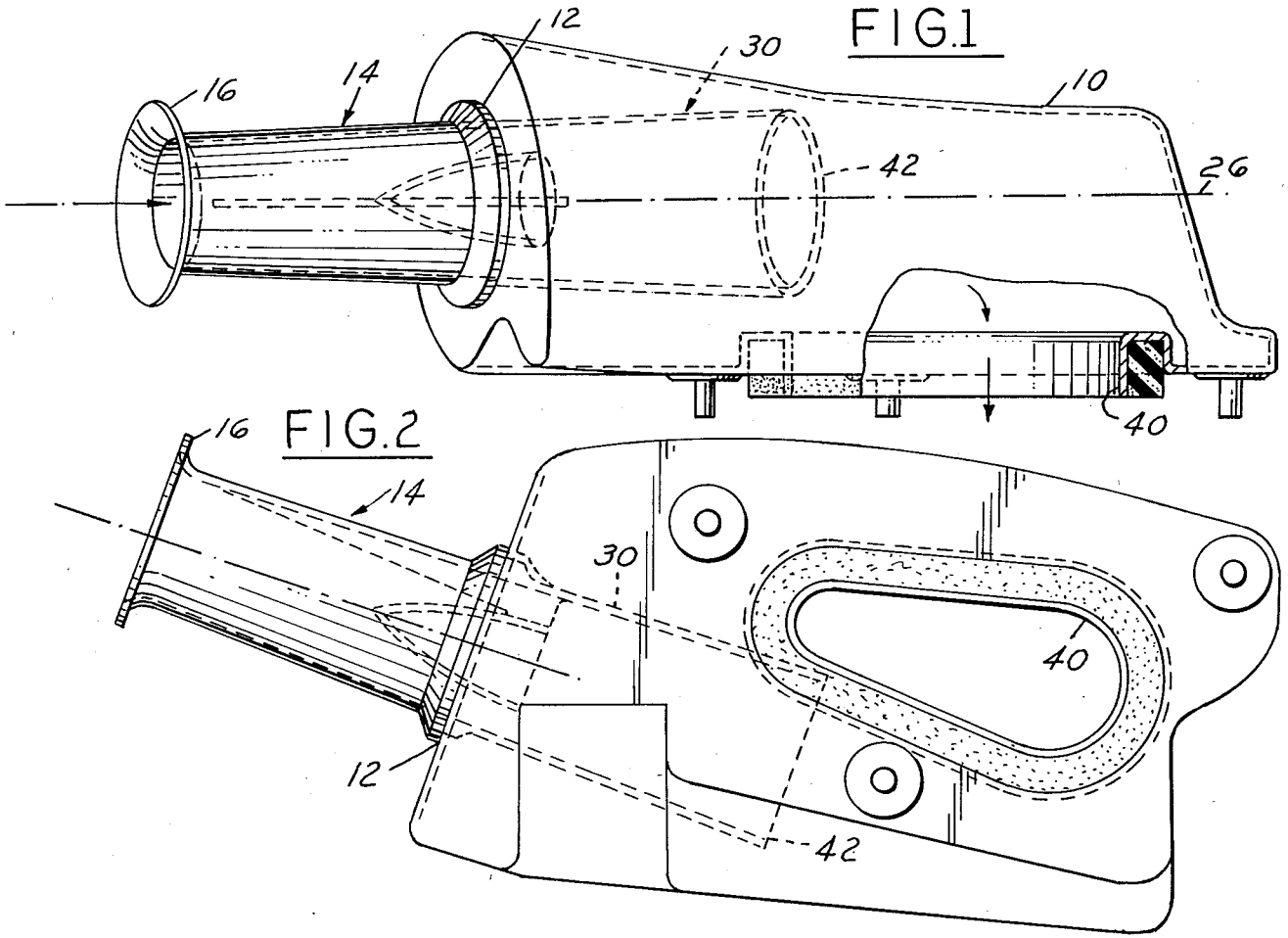
FIG. 1 is a side elevational view of a combination engine air inlet-noise silencer embodying the invention, with parts broken away and in section.
FIG. 2 is a bottom view looking up of the showing in FIG. 1.
Figure 3:
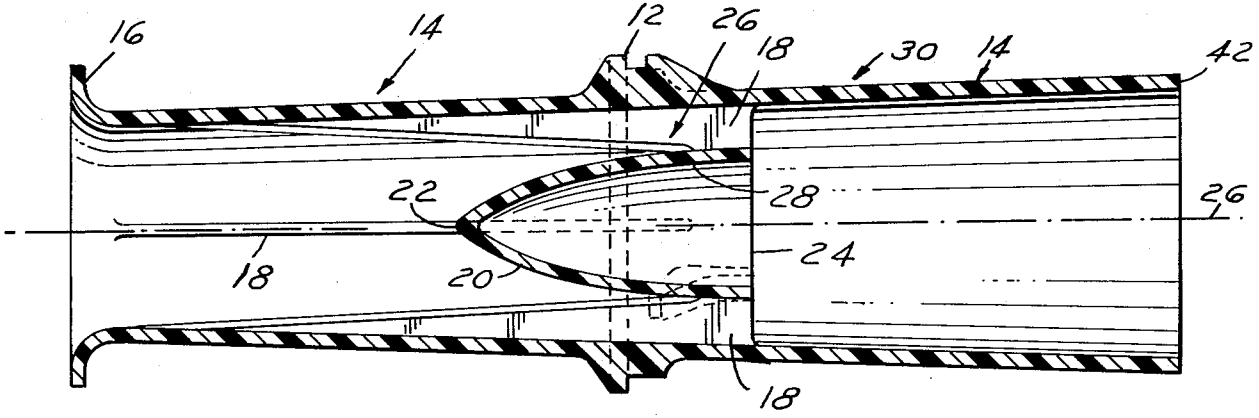
FIG. 3 is an enlarged cross-sectional view of a portion of the FIG. 1 showing.
Figure 4:
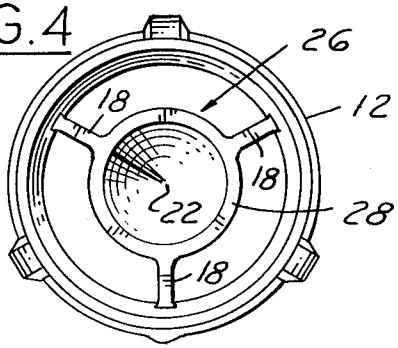
FIG. 4 is a view from the left-hand portion of the FIG. 3 showing.

FIG. 1 and 2 show a hollow or shell-type housing 10 of enlarged volume that constitutes and expansion chamber, as will be explained more clearly later. Located to one side of housing 10 is an inlet opening 12 through which is inserted a snorkel-like air inlet tube 14 chamfered at one end 16. The tube tapers axially to gradually increase in cross-sectional area in a downstream direction, as shown more clearly in FIG. 3. Fixedly located within the tube by a number of circumferentially spaced ribs 18 is a conical-like insert 20. The latter has an apex portion 22 and a flat base portion 24, the base portion extending at right angles to the longitudinal axis 26 of the tube 14. Insert 20 thus is a closed member centrally located in the tube to define an air annulus 26 between the outer walls 28 of the insert and the walls 30 defining the air tube 14. The particular angularity of the walls 28 would be chosen to provide a minimum restriction to flow of air through the annulus 26 while at the same time increasing the velocity of the air through the annulus 26, with its consequential pressure drop. The gradually tapering walls 30 of that portion of the inlet downstream of base portion 24, however, constitutes a diffuser of gradually increasing cross-sectional area providing good pressure recovery to the air flow.

Returning to FIGS. 1 and 2, it will be seen that the air exiting from insert 14 passes into the large volume of the housing 10 which constitutes an expansion chamber for further pressure recovery of the air flow. The air then is turned at right angles to pass through an outlet 40 located in the lowr portion of housing 10 of a controlled size, as shown in FIG. 2.

Simultaneous with the passage of air flow into the induction system of the engine, induction system noise is fed back through outlet 40 into housing 10 where it is partially broken-up and dissipated against the walls of the housing. Some of the noise attempts to pass into outlet 42 of inlet tube 14. At this point, however, the acoustical waves are stopped to a large degree by bombardment against the flat base portion 24 of cone member 20, which reflects them back towards the engine into the expansion chamber where they are reduced. Other sound waves bounce off the wall 24 against the walls 30 of the diffuser to also be dampened, broken-up or dissipated.

From the foregoing, it will be seen that the invention provides a combination air inlet-engine noise silencer of a simple construction, and yet one effective to reduce engine induction noise feedback by the provision of a conical-like insert in the engine air inlet duct that increases the air velocity for more efficient engine operation while simultaneously minimizing the flow of acoustical waves from the engine back into the inlet by the reflection of the waves off the base portion of the conical-like insert against the slanting walls of the diffuser portion of the air inlet tube and into the expansion chamber in various directions to be broken-up and dissipated.

While the invention has been shown and described in its preferred embodiment, it would be clear to those skilled in the arts to which it pertains that many changes and modifications may be made thereto without departing from the scope of the invention.

I claim:

1. An air inlet housing for an internal combustion engine having an air induction system, comprising an enlarged volume shell-type housing having walls defining the housing and a snorkel-like air inlet tube extending through an opening in one of the walls into a portion of the housing and an air outlet through another wall of the housing adapted to be connected to the engine induction system for the induction of air thereto, the inlet tube having a volume small relative to the enlarged volume of the housing whereby the housing constitutes an expansion chamber, the relative smaller volume of the inlet tube to the larger volume of the expansion chamber causing a sudden expansion in area as the air exit from the tube into the expansion chamber, and a conical-like engine induction noise reducing flow controlling insert coaxially positioned in the inlet tube, the insert being shaped to have apex and base portions situated upstream and downstream, respectively, in the tube, whereby the induction of air by the engine through the inlet tube increases the velocity and lowers the pressure thereof upon passage past the insert for the flow of air into the expansion chamber and therefrom into the engine in an efficient manner, the engine induction system passing acoustical waves into the large expansion chamber to be dissipated therein, any passage therefrom towards the inlet tube flowing against the base portion reflecting the waves back into the expansion chamber to be broken-up and dissipated therein, the inlet tube and outlet each have an axis so located that the axis of the outlet from the chamber is located essentially at right angles to the axis of the inlet tube providing greater reflection of the acoustical waves off the walls of the expansion chamber and absorption of the acoustical energy therein.

2. A housing as in claim 1, the base portion extending at right angles to the apex portion of the inlet tube for maximum blockage of passage of the acoustical waves from the engine towards the apex portion of the inlet tube.

3. A housing as in claim 1, the insert defining an air annulus of controlled area between the insert and a wall defining the inlet tube for increasing the velocity of the air with minimum restriction to flow.

4. A housing as in claim 1, wherein the flow of air into the expansion chamber effects a pressure recovery thereto.

5. A housing as in claim 1, wherein the insert is located essentially centrally axially in the inlet tube, the tube tapering gradually outwardly downstream to constitute an efficient diffuser for good pressure recovery.

* * * * *